US011986096B2

(12) United States Patent
Ohno et al.

(10) Patent No.: US 11,986,096 B2
(45) Date of Patent: May 21, 2024

(54) AIR MATTRESS

(71) Applicant: PARAMOUNT BED CO., LTD., Tokyo (JP)

(72) Inventors: Kenta Ohno, Tokyo (JP); Hidekazu Nagai, Tokyo (JP); Takayuki Arimatsu, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 219 days.

(21) Appl. No.: 17/055,701

(22) PCT Filed: Jun. 17, 2019

(86) PCT No.: PCT/JP2019/023862
§ 371 (c)(1),
(2) Date: Nov. 16, 2020

(87) PCT Pub. No.: WO2020/148929
PCT Pub. Date: Jul. 23, 2020

(65) Prior Publication Data

US 2021/0186226 A1 Jun. 24, 2021

(30) Foreign Application Priority Data

Jan. 15, 2019 (JP) ..... 2019-004774

(51) Int. Cl.
*A47C 27/10* (2006.01)
*A47C 27/08* (2006.01)

(52) U.S. Cl.
CPC ..... *A47C 27/10* (2013.01); *A47C 27/082* (2013.01)

(58) Field of Classification Search
CPC ..... A47C 27/08; A47C 27/082; A47C 27/083; A47C 27/084; A47C 27/087; A47C 27/088; A47C 27/10
See application file for complete search history.

(56) References Cited

U.S. PATENT DOCUMENTS 4,998,310 A * 3/1991 Olson ..... A47C 27/18 5/710
5,249,319 A * 10/1993 Higgs ..... A47C 27/18 5/713

(Continued)

FOREIGN PATENT DOCUMENTS

CN 1551737 A 12/2004
CN 102475465 A 5/2012

(Continued)

OTHER PUBLICATIONS

International Search Report dated Aug. 28, 2019, mailed in counterpart International Application No. PCT/JP2019/023862, 5 pages.

*Primary Examiner* — David R Hare
*Assistant Examiner* — George Sun
(74) *Attorney, Agent, or Firm* — Kim & Stewart LLP

(57) ABSTRACT

According to the embodiments, an air mattress includes an air cell unit, a first side edge unit, and a first pump unit. The air cell unit includes a plurality of air cells that are arranged along a first direction. The first side edge unit includes a polymeric foam. A direction from the first side edge unit to a first portion of the air cell unit is along a second direction that intersects the first direction. The first pump unit performs supply and exhaust of air to and from at least a part of the plurality of the air cells. A direction from the first pump unit to a second portion of the air cell unit is along the second direction. A direction from the first side edge unit to the first pump unit is along the first direction.

16 Claims, 6 Drawing Sheets

(56) References Cited

U.S. PATENT DOCUMENTS 6,151,735 A * 11/2000 Koby ..... A47C 27/084 5/644
9,392,875 B2 * 7/2016 Weyl ..... A61G 7/05784
2002/0073489 A1 * 6/2002 Totton ..... A47C 27/006 5/713
2002/0148045 A1 * 10/2002 Giori ..... A47C 27/15 5/709
2003/0041378 A1 * 3/2003 Davis ..... A47C 20/048 5/723
2003/0221256 A1 * 12/2003 Monk ..... F41H 5/08 5/722
2004/0261183 A1 * 12/2004 Tsai ..... F04D 25/084 5/713
2009/0100605 A1 * 4/2009 Caminade ..... A61G 7/05776 5/713
2010/0170044 A1 * 7/2010 Kao ..... A47C 27/083 5/710
2012/0311790 A1 * 12/2012 Nomura ..... A47C 27/10 5/710
2012/0317727 A1 * 12/2012 Tanaka ..... A61G 7/057 5/710
2013/0081205 A1 * 4/2013 Frondorf ..... A61G 7/015 5/613
2013/0180052 A1 * 7/2013 Chen ..... A47C 27/082 5/711
2014/0101861 A1 * 4/2014 Gowda ..... A61G 7/05792 5/709
2014/0201909 A1 * 7/2014 Weyl ..... A61G 7/05792 5/423
2017/0000685 A1 * 1/2017 Rohr ..... A47C 21/006
2017/0202364 A1 * 7/2017 Ohno ..... A61G 7/057
2017/0251823 A1 * 9/2017 Nakamura ..... A47C 27/082
2018/0042396 A1 * 2/2018 Nakamura ..... A61G 7/05769
2019/0387898 A1 * 12/2019 Switlik ..... A47C 27/082

FOREIGN PATENT DOCUMENTS

CN 105796267 A 7/2016
CN 107149334 A 9/2017
DE 102015012579 A1 5/2016
DE 102017000061 A1 9/2017
GB 2463510 A 3/2010
JP H02144011 A 6/1990
JP 2004-008466 A 1/2004
JP 2005-211399 A 8/2005
JP 2011160894 A 8/2011
JP 2013078577 A 5/2013
JP 2015128571 A 7/2015
JP 2016087117 A 5/2016
JP 2017-080252 A 5/2017
JP 2017153743 A 9/2017
WO 2020148929 A1 7/2020

* cited by examiner

AIR MATTRESS

TECHNICAL FIELD

Embodiments of the present invention relate to an air mattress.

BACKGROUND ART

There are air mattresses in which air cells are used. The air mattresses are desired to be more comfortable.

CITATION LIST

Patent Literature

PTL 1: JP-A-2011-160894

SUMMARY OF INVENTION

Technical Problem

Embodiments of the present invention provide a more comfortable air mattress.

Solution to Problem

According to the embodiments, an air mattress includes an air cell unit, a first side edge unit, and a first pump unit. The air cell unit includes a plurality of air cells that are arranged along a first direction. The first side edge unit includes a polymeric foam. A direction from the first side edge unit to a first portion of the air cell unit is along a second direction that intersects the first direction. The first pump unit performs supply and exhaust of air to and from at least a part of the plurality of the air cells. A direction from the first pump unit to a second portion of the air cell unit is along the second direction. A direction from the first side edge unit to the first pump unit is along the first direction.

Advantageous Effects of Invention

The embodiments of the present invention can provide a more comfortable air mattress.

DESCRIPTION OF EMBODIMENTS

Figure 1:
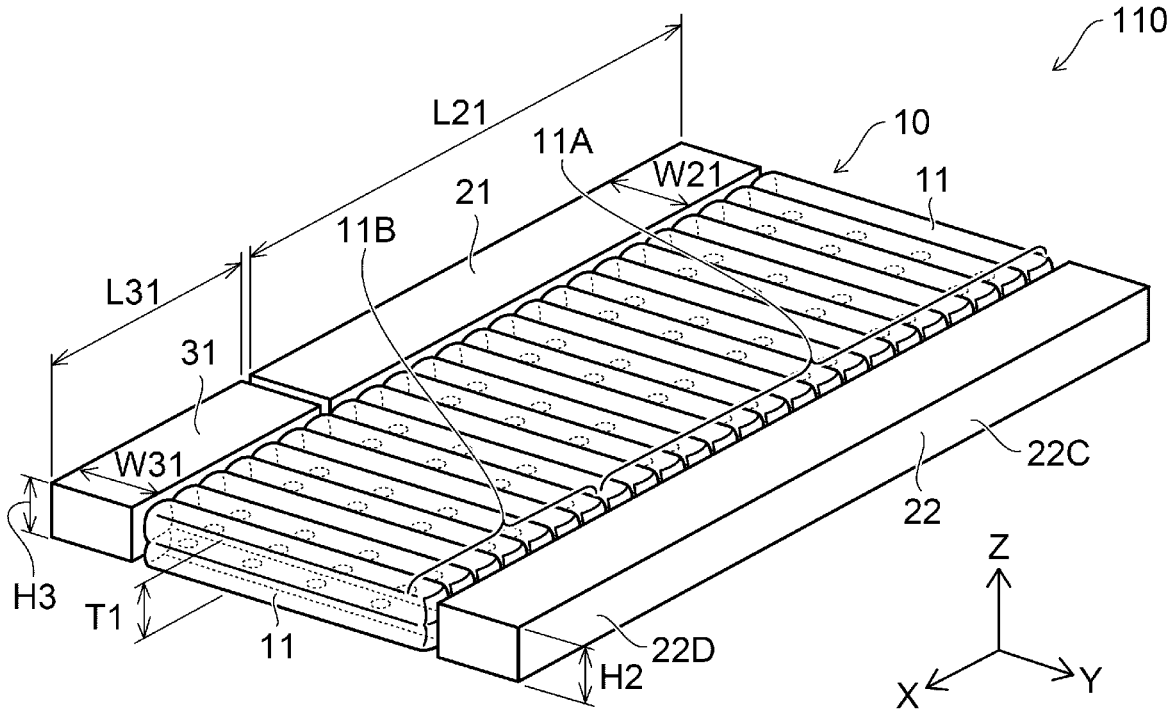
FIG. 1 is a schematic perspective view exemplifying an air mattress according to a first embodiment.

Hereinafter, embodiments of the invention will be described with reference to the drawings.

The drawings are schematic or conceptual, and the relation between the thickness and the width in each portion, and the ratio of the sizes between portions, and the like are not necessarily the same as actual ones. Even when the same portion is illustrated, the same portion is illustrated mutually differently in the size and the ratio depending on the drawing in some cases.

In the specification of the present application and the respective drawings, the similar elements having been described related to the already described drawing are assigned with the same reference numerals, and detailed explanations thereof are omitted as appropriate.

First Embodiment

Figure 2:
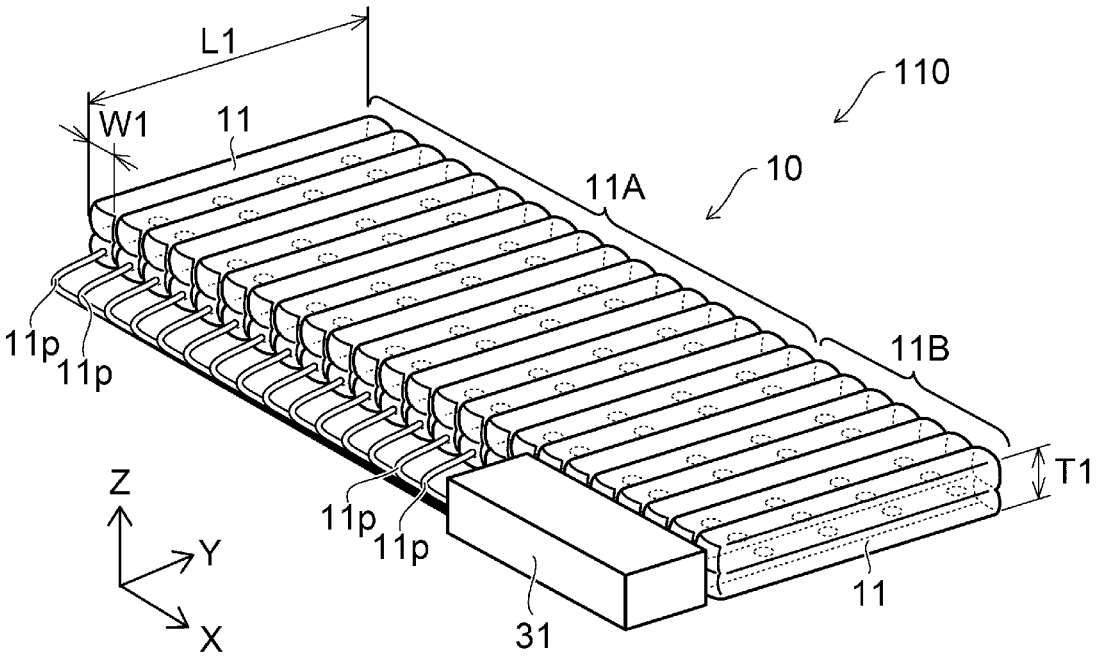
FIG. 2 is a schematic perspective view exemplifying the air mattress according to the first embodiment.

FIGS. 1 and 2 are schematic perspective views exemplifying an air mattress according to a first embodiment.

As illustrated in FIG. 1, an air mattress 110 according to the embodiment includes an air cell unit 10, a first side edge unit 21, and a first pump unit 31. In this example, a second side edge unit 22 is further provided.

In FIG. 2, for easy recognition of the drawing, a state where the first side edge unit 21 and the second side edge unit 22 have been removed is exemplified.

As illustrated in FIG. 1, the air cell unit 10 includes a plurality of air cells 11. The plurality of the air cells 11 are arranged along a first direction.

An X axis direction is set as the first direction. One direction perpendicular to the X axis direction is set as a Z axis direction. A direction perpendicular to the X axis direction and the Z axis direction is set as a Y axis direction.

The first direction corresponds to, for example, a direction from the head to the legs when a user is laid on the air mattress 110. The Y axis direction corresponds to a right-and-left direction. The Z axis direction corresponds to a direction from a lower surface to an upper surface of the air mattress 110.

The air cell unit 10 includes a first portion 11A and a second portion 11B. The first portion 11A is, for example, a portion at a head side. The second portion 11B is, for example, a portion at a feet side. The first portion 11A includes a plurality of the air cells 11. The second portion 11B includes another plurality of the air cells 11. A direction from the first portion 11A to the second portion 11B is along the first direction (X axis direction).

The first side edge unit 21 includes a polymeric foam. The polymeric foam includes, for example, an urethane foam. The first side edge unit 21 is porous. The polymeric foam includes a plurality of holes.

A direction from the first side edge unit 21 to the first portion 11A of the air cell unit 10 is along the second direction. The second direction intersects the first direction (X axis direction). In this example, the second direction is along the Y axis direction.

The first pump unit 31 performs supply and exhaust of air to and from at least a part of the plurality of the air cells 11. A direction from the first pump unit 31 to the second portion 11B of the air cell unit 10 is along the second direction (for example, Y axis direction). A direction from the first side edge unit 21 to the first pump unit 31 is along the first direction (X axis direction).

As illustrated in FIG. 2, the first pump unit 31 is connected to the plurality of the air cells 11 through a plurality of tubes 11*p*. Supply and exhaust of air are performed through the plurality of the tubes 11.

The air that is sent from the first pump unit 31 raises internal pressures in the plurality of the air cells 11. Exhaust of air by the first pump unit 31 lowers the internal pressures in the plurality of the air cells 11. The internal pressures in the plurality of the air cells 11 are capable of being adjusted, for example so as to match a preference of a user of the air mattress 110.

The user lies down on the air cell unit 10. The internal pressure in the air cell 11 is adjusted so as to obtain a suitable repulsion force in a state where the user is laid on the air cell unit 10.

For example, in a case where a user of the air mattress is a care recipient or the like, the user hardly gets up from the air mattress. Meanwhile, in a case where a user is a healthy individual, the user gets up from the air mattress with his/her own power. For example, there is a reference example in which no side edge unit is provided but only the air cell unit 10 is provided. In such a reference example, it has been understood that when the user is in a sitting-on-bed-edge of the air cell unit 10, the posture of the user becomes unstable in some cases. It can be considered that this is because the user is likely to slip down due to each air cell with an edge portion having a curved surface shape, in addition to each air cell being soft. For example, it has been understood that in a case where intending to get up from the sitting-on-bed-edge, the user becomes an unstable posture in some cases.

In the embodiment, the first side edge unit 21 is provided. The first side edge unit 21 is, for example, a cushion such as an urethane foam. The first side edge unit 21 includes no air cell. Accordingly, the sitting-on-bed-edge on the first side edge unit 21 is stable similar to the general mattress. Therefore, the posture of the user in the sitting-on-bed-edge on the first side edge unit 21 is stable. When the user intends to stand up from the sitting-on-bed-edge, the posture of the user is also stable.

With the embodiment, a more comfortable air mattress can be provided.

In the embodiment, the first pump unit 31 is disposed in the vicinity of a feet unit. This can prevent the vibration (including sound and the like) due to the operation by the pump from hindering the sleep of the user.

In the embodiment, the first side edge unit 21 does not overlap with the air cell unit 10 in a third direction (for example, the Z axis direction) that intersects a plane (for example an X-Y plane) including the first direction and the second direction. The first side edge unit 21 does not overlap with the air cell unit 10, for example, so that comfortable softness can be provided.

The first pump unit 31 does not overlap with the air cell unit 10 in the third direction (for example, the Z axis direction). The first pump unit 31 does not overlap with the air cell unit 10, so that the internal pressure in the air cell 11 can be easily and adequately controlled. For example, comfortable softness can be provided.

As illustrated in FIG. 1, the air mattress 110 may further include the second side edge unit 22. The second side edge unit 22 includes a polymeric foam (for example, an urethane foam). The second side edge unit 22 is porous. The first portion 11A is present, in the second direction (for example, the Y axis direction), between the first side edge unit 21 and a part (third portion 22C) of the second side edge unit 22. The second portion 11B is present, in the second direction (for example, the Y axis direction), between the first pump unit 31 and another part (fourth portion 22D) of the second side edge unit 22.

The first side edge unit 21 and the second side edge unit 22 are provided, so that in the both left and right sides, the sitting-on-bed-edge of the user can be stabilized. The user can easily stand up from either of the left and right sides.

Figure 6:
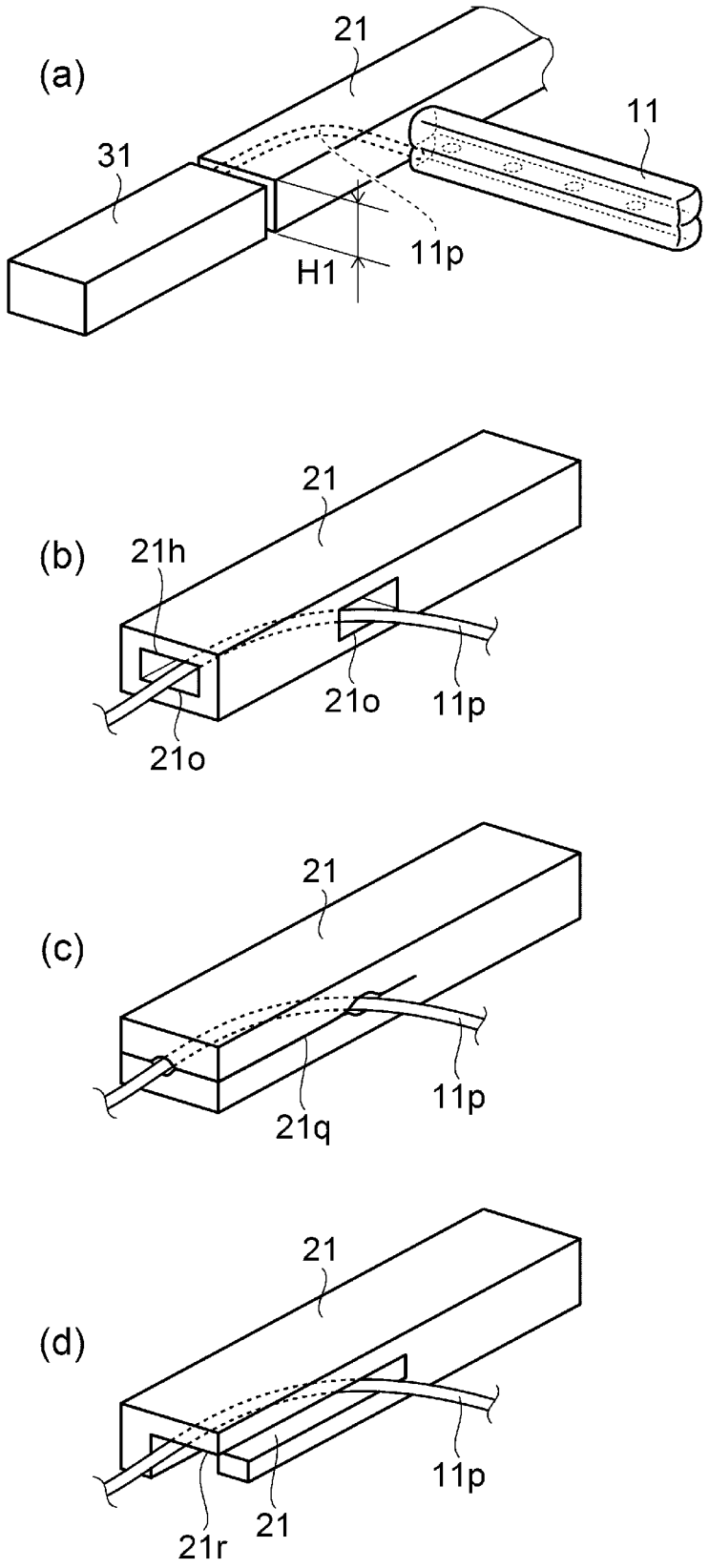
FIGS. 6(*a*) to 6(*d*) are schematic perspective views exemplifying a part of an air mattress according to a fourth embodiment.

The thickness of the first side edge unit 21 is set to a thickness H1 (see FIG. 6(*a*)). The thickness of the second side edge unit 22 is set to a thickness H2 (see FIG. 1). The thickness of the first pump unit 31 is set to a thickness H3 (see FIG. 1). These thicknesses respectively correspond to the lengths in the Z axis direction. These thicknesses may be substantially identical with one another. A difference among these thicknesses is equal to or less than 20% of a mean value of these thicknesses. The overall thickness of the air mattress 110 becomes uniform, so that comfortable sleep can be easily provided.

The first pump unit 31 may include a pump case, an upper-side resin layer, and a lower-side resin layer. The pump case between the upper-side resin layer and the lower-side resin layer is provided. The thickness H3 of the first pump unit 31 corresponds to a total thickness pf the pump case, the upper-side resin layer, and the lower-side resin layer.

The thickness of the air cell unit 10 is set to a thickness T1 (see FIG. 1). The thickness T1 corresponds to a length in the Z axis direction of the air cells 11 when the air cells 11 inflate (for example, when the user is laid). The thickness T1 may be substantially identical with each of thicknesses H1 to H3. A difference between the thickness T1 and the thickness H1 is, for example, equal to or more than 0.8 times and equal to or less than 1.2 times the thickness H1.

A length (width W21) along the second direction (Y axis direction) of the first side edge unit 21 may be substantially identical with a length (width W31) along the second direction of the first pump unit 31. The width W21 is equal to or more than 0.8 times and equal to or less than 1.2 times the width W31. The air mattress 110 has a substantially rectangular appearance, and is likely to be used.

In the embodiment, the respective widths of the plurality of the air cells 11 may be substantially the same. As illustrated in FIG. 2, the respective lengths of the plurality of the air cells 11 along the second direction (Y axis direction) are set to lengths L1. In the plurality of the air cells 11, the fluctuation in the lengths L1 is equal to or less 20%. The plurality of the air cells 11 have the substantially same length L1, so that, for example, manufacturing thereof becomes easy. The lengths L1 become substantially the same, so that, for example, the respective capacitances of the plurality of the air cells 11 become the same. Therefore, the control of the internal pressures in the air cells 11 becomes easy.

In the embodiment, the length L1 of the air cells 11 in a portion corresponding to feet of the user is similar to that in the other portions. The left-right lengths in the soft portions (air cell portions) from the upper body to the feet unit are substantially the same. Even if the user moves his/her feet in the width similar to the left-right width of his/her upper body, comfortable sleep can be provided.

The plurality of the air cells 11 extend along the second direction (Y axis direction). The length L1 along the second direction of one in the plurality of the air cells 11 is longer than a length W1 along the first direction (X axis direction) in the one of the plurality of the air cells 11 (see FIG. 2). The length L1 is longer than the thickness T1 (see FIG. 2).

As illustrated in FIG. 1, the length along the first direction (X axis direction) of the first side edge unit 21 is set to a length L21. The length along the first direction of the first pump unit 31 is set to a length L31. The length L21 is preferably longer than the length L31. The length L21 is, for example, equal to or more than 2 times the length L31. The first side edge unit 21 is softer than the first pump unit 31. The length L21 is longer than the length L31 to allow a region of a soft portion in the side unit of the air mattress 110 to make longer. A region in which comfortable sitting-on-bed-edge can be obtained can be made wider. The length L21 may be, for example, equal to or less than 20 times the length L31.

In the embodiment, when in use, the air cell unit 10, the first side edge unit 21, the second side edge unit 22, the first pump unit 31, and the like exemplified in FIGS. 1 and 2 are contained into a bag-like cover unit (which is not illustrated).

Second Embodiment

Figure 3:
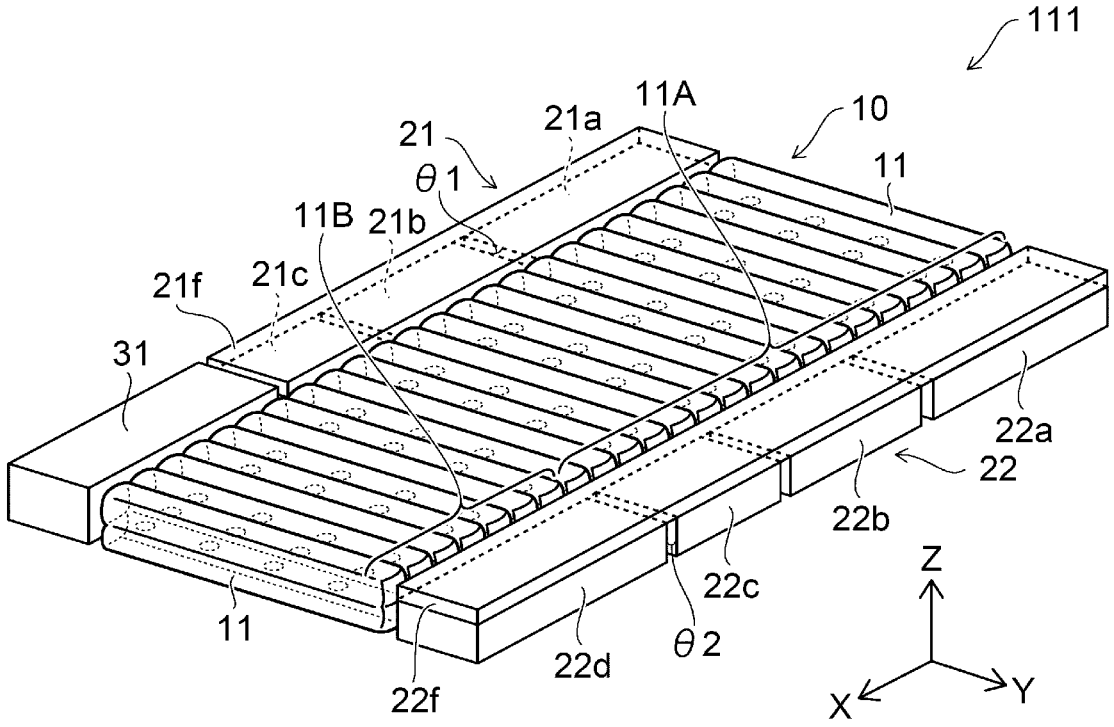
FIG. 3 is a schematic perspective view exemplifying an air mattress according to a second embodiment.

FIG. 3 is a schematic perspective view exemplifying the air mattress according to a second embodiment.

As illustrated in FIG. 3, an air mattress 111 according to the embodiment includes the air cell unit 10, the first side edge unit 21, and the first pump unit 31. In this example, the second side edge unit 22 is further provided.

As illustrated in FIG. 3, in the air mattress 111, the first side edge unit 21 includes a plurality of first side edge elements (in this example, elements 21*a* to 21*c*). The second side edge unit 22 includes a plurality of second side edge elements (in this example, elements 22*a* to 22*d*).

The plurality of the first side edge elements are joined to a first side edge base material 21*f*. The plurality of the second side edge elements are joined to a second side edge base material 22*f*. The first side edge base material 21*f* and the second side edge base material 22*f* include, for example, a polymeric foam (for example, an urethane foam). In the embodiment, "joining" includes bonding or fusing.

The first side edge base material 21*f* and the second side edge base material 22*f* have, for example, stretching-contracting properties and cushioning properties. The direction from the plurality of the first side edge elements to the first side edge base material 21*f* is along the Z axis direction. The direction from the plurality of the second side edge elements to the second side edge base material 22*f* is along the Z axis direction.

An angle θ1 (see FIG. 3) between two of the plurality of the first side edge elements is changeable. An angle θ2 (see FIG. 3) between two of the plurality of the second side edge elements is changeable.

Figure 4:
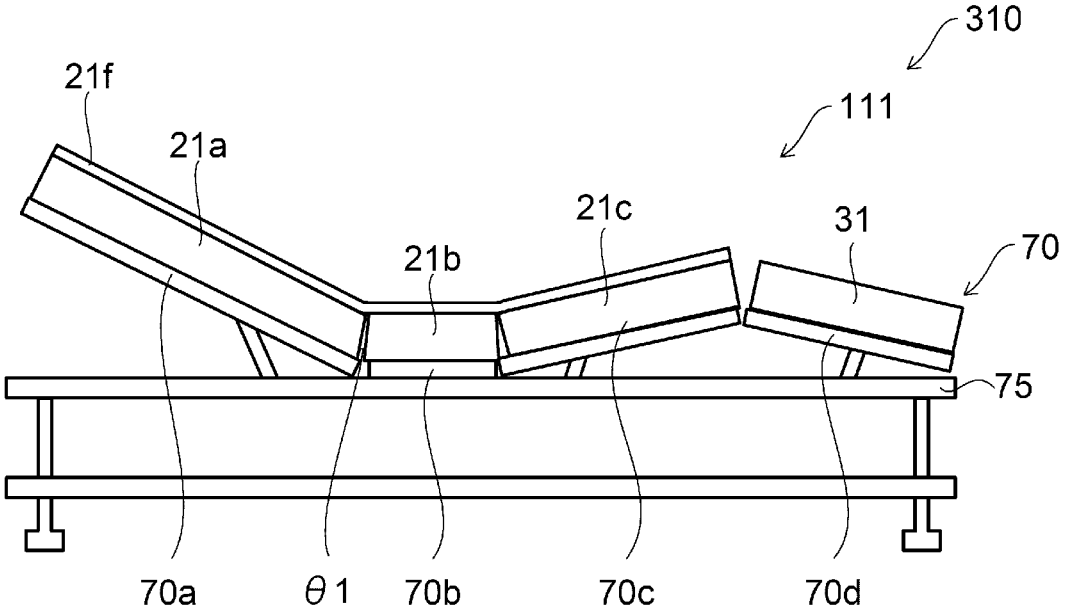
FIG. 4 is a schematic side view exemplifying a use state of the air mattress according to the second embodiment.

FIG. 4 is a schematic side view exemplifying a use state of the air mattress according to the second embodiment.

As illustrated in FIG. 4, the air mattress 111 may be disposed on a bed 70. The bed 70 is, for example, a motorized bed. The bed 70 includes, for example, a back section 70*a*, a hip section 70*b*, an upper leg section 70*c*, and a lower leg section 70*d*. These sections are supported, for example, by a frame 75. An angle between these sections is changeable.

The air mattress 111 is disposed on such the bed 70 in some cases. The air mattress 111 and the bed 70 are included in a motorized furniture 310.

In the present embodiment, the side edge unit includes a plurality of side edge elements, and the angle (the angle 81, the angle 82, or the like) between two of the plurality of the side edge elements is changeable. When such the air mattress 111 is disposed on the bed 70, and the section unit of the bed 70 is deformed, the air mattress 111 easily follows the deformation of the section unit. For example, a force to be applied to the side edge units is distributed, so that the side edge units can be prevented from being broken.

Third Embodiment

Figure 5:
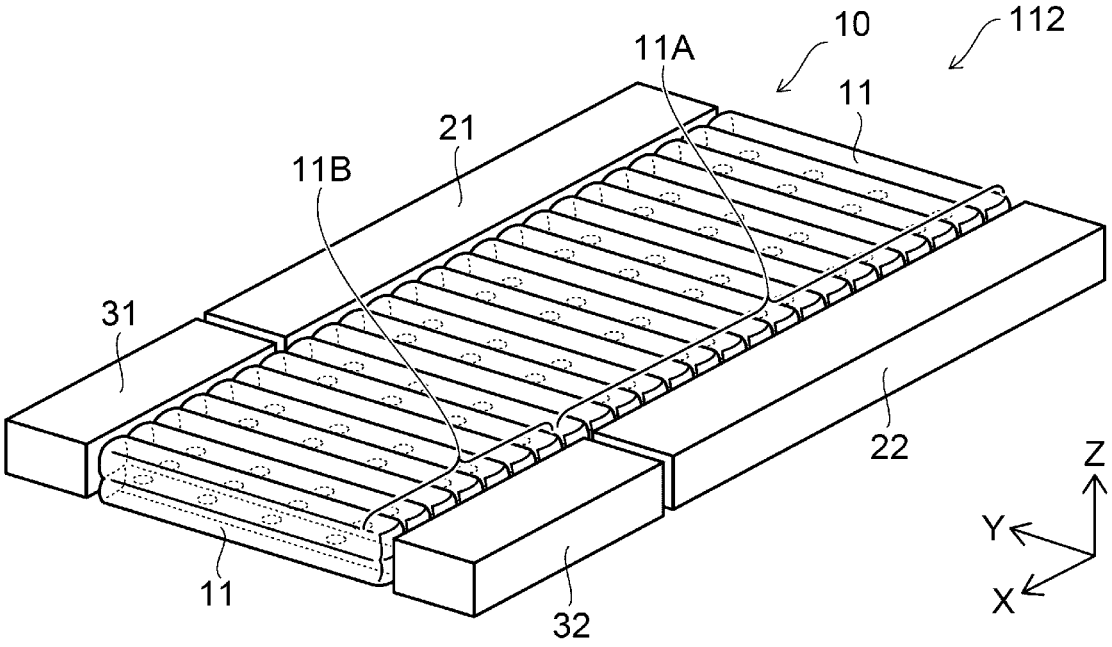
FIG. 5 is a schematic perspective view exemplifying an air mattress according to a third embodiment.

FIG. 5 is a schematic perspective view exemplifying an air mattress according to a third embodiment.

As illustrated in FIG. 5, an air mattress 112 according to the embodiment includes, in addition to the air cell unit 10, the first side edge unit 21, and the first pump unit 31, the second side edge unit 22 and a second pump unit 32.

The second side edge unit 22 includes a polymeric foam (for example, an urethane foam). The second pump unit 32 performs supply and exhaust of air to and from at least a part of the plurality of the air cells 11. The second pump unit 32 is connected to at least a part of the plurality of the air cells 11 through tubes (illustration is omitted in FIG. 5) similar to the tubes 11*p* and the like exemplified in FIG. 2.

The first portion 11A of the air cell unit 10 is present, in the second direction (for example, the Y axis direction), between the first side edge unit 21 and the second side edge unit 22. The second portion 11B of the air cell unit 10 is present, in the second direction (for example, the Y axis direction), between the first pump unit 31 and the second pump unit 32. A direction from the second side edge unit 22 to the second pump unit 32 is along the first direction (X axis direction).

The plurality of the pump units are provided, so that the internal pressures in the plurality of the air cells 11 are likely to be controlled more appropriately.

Fourth Embodiment

FIGS. 6(*a*) to 6(*d*) are schematic perspective views exemplifying a part of an air mattress according to a fourth embodiment.

These drawings exemplify states of the tube 11*p*. The tube 11*p* connects at least a part of the plurality of the air cells 11 to the first pump unit 31.

In FIG. 6(*a*), for easy recognition of the drawing, one of the plurality of the air cells 11 is drawn. As illustrated in FIG. 6(*a*), at least a part of the tube 11*p* passes through an inside of the first side edge unit 21.

As the example in FIG. 6(*b*), for example, the first side edge unit 21 includes a hole 21*h*. The hole 21*h* includes an opening part 21*o*. At least a part of the tube 11*p* passes through the hole 21*h* (and the opening part 21*o*).

In the example illustrated in FIG. 6(*c*), the first side edge unit 21 includes a slit 21*q*. At least a part of the tube 11*p* passes through the slit 21*q*.

In the example illustrated in FIG. 6(*d*), the first side edge unit 21 includes a concave part 21*r*. At least a part of the tube 11*p* is present in the concave part 21*r*.

At least apart of the tube 11*p* passes through the inside of the first side edge unit 21, so that, for example, the tube 11*p* can be prevented from being crushed or bent. The internal pressure in the air cell 11 is likely to be stably controlled.

In the embodiment, the first side edge unit 21 is provided to stabilize the sitting-on-bed-edge. The length L1 of the air cell 11 in the feet portion is identical with that in the other portions, so that the user is comfortable even if moving his/her feet largely. In a case where the user is a healthy individual, the air mattress especially becomes easy to use.

The embodiments may include the following configurations.

Configuration 1

An air mattress provided with: an air cell unit including a plurality of air cells that are arranged along a first direction;

a first side edge unit including a polymeric foam, in the first side edge unit, a direction from the first side edge unit to a first portion of the air cell unit being along a second direction that intersects the first direction; and a first pump unit that performs supply and exhaust of air to and from at least a part of the plurality of the air cells, in the first pump unit, a direction from the first pump unit to a second portion of the air cell unit being along the second direction, and a direction from the first side edge unit to the first pump unit being along the first direction.

Configuration 2

The air mattress according to Configuration 1, further provided with a second side edge unit including a polymeric foam, in which the first portion is present, in the second direction, between the first side edge unit and a third portion of the second side edge unit, and the second portion is present, in the second direction, between the first pump unit and a fourth portion of the second side edge unit.

Configuration 3

The air mattress according to Configuration 1, provided with: the second side edge unit including the polymeric foam, and a second pump unit that performs supply and exhaust of air to and from at least a part of the plurality of the air cells, in which the first portion is present, in the second direction, between the first side edge unit and the second side edge unit, the second portion is present, in the second direction, between the first pump unit and the second pump unit, and a direction from the second side edge unit to the second pump unit is along the first direction.

Configuration 4

The air mattress according to Configuration 2 or 3, in which the second side edge unit includes a plurality of second side edge elements, and an angle between two of the plurality of the second side edge elements is changeable.

Configuration 5

The air mattress according to any one of Configurations 1 to 4, in which the first side edge unit includes a plurality of first side edge elements, and an angle between two of the plurality of the first side edge elements is changeable.

Configuration 6

The air mattress according to any one of Configurations 1 to 5, further provided with a tube that connects at least a part of the plurality of the air cells to the first pump unit, in which at least a part of the tube passes through an inside of the first side edge unit.

Configuration 7

The air mattress according to any one of Configurations 1 to 6, further provided with a tube that connects at least a part of the plurality of the air cells to the first pump unit, in which the first side edge unit includes a concave part, and at least a part of the tube is present in the concave part.

With the embodiments, a more comfortable air mattress can be provided.

In the foregoing, the embodiments of this disclosure have been described with reference to the specific examples. However, the present invention is not limited to these specific examples. For example, the specific configurations of the respective elements such as the air cell unit, the side edge units, and the pump unit, which are included in the air mattress, can be included in the scope of the present invention, as long as those skilled in the art can similarly implement the present invention by the appropriate selection from the publicly known range, and obtain the similar effects.

The combination of any two or more elements in the specific examples within a technically possible range is included in the scope of the present invention as long as it includes the gist of the present invention.

In addition, all the air mattresses that can be implemented through the design changes as appropriate by those skilled in the art based on the air mattresses described above as the embodiments of the present invention belong to the scope of the present invention as long as the gist of the present invention is included.

In addition, within the spirit of the present invention, those skilled in the art can conceive of various changes and modifications, and it is understood that these changes and modifications also belong to the scope of the present invention.

REFERENCE SIGNS LIST

10 . . . air cell unit, 11 . . . air cell, 11A, 11B . . . first, second portion, 11*p* . . . tube, 21 . . . first side edge unit, 21*a* to 21*c* . . . element, 21*f* . . . side edge base material, 21*h* . . . hole, 21*o* . . . opening part, 21*q* . . . slit, 21*r* . . . concave part, 22 . . . second side edge unit, 22C . . . third portion, 22D . . . fourth portion, 22*a* to 22*d* . . . element, 22*f* . . . second side edge base material, 31, 32 . . . first, second pump unit, 70 . . . bed, 70*a* . . . back section, 70*b* . . . hip section, 70*c* . . . upper leg section, 70*d* . . . lower leg section, 75 . . . frame, θ1, θ2 . . . angle, 110, 111 . . . air mattress, 310 . . . motorized furniture, H1 to H3 . . . thickness, L1, L21, L31 . . . length, T1 . . . thickness, W1, W21, W31 . . . width

The invention claimed is:

1. An air mattress comprising:

an air cell unit including a plurality of air cells that are arranged along a first direction, which is a head-to-leg direction of the air mattress, the air cell unit including:

a first portion including a first plurality of air cells; and a second portion including a second plurality of air cells, the first and second portions being adjacent to one another in the first direction, each of the first and second plurality of air cells extending in a second direction intersecting the first direction and having a same length in the second direction, the second direction being a left-to-right direction of the air mattress, an air-communicating space in each of the first and second plurality of air cells crossing a center of the air mattress in the second direction;

a first side edge unit including a polymeric foam and no air cell, the first side edge unit being adjacent in the second direction to the first portion of the air cell unit; and a first pump in a case, the first pump being configured to supply and exhaust air to and from the plurality of the air cells, the case being provided separately from the first side edge unit and being adjacent in the second direction to the second portion of the air cell unit and adjacent in the first direction to the first side edge unit, the case having a same width in the second direction as the first side edge unit, a side surface of the case of the first pump and a side surface of the first side edge unit facing each other in the first direction.

2. The air mattress according to claim 1, further comprising:

a second side edge unit including a polymeric foam and no air cell, the second side edge unit being adjacent to the air cell unit in the second direction, wherein the first portion is between the first side edge unit and the second side edge unit in the second direction, and the second portion is between the case of the first pump and the second side edge unit in the second direction.

3. The air mattress according to claim 1, further comprising:

a second side edge unit including a polymeric foam and no air cell, the second side edge unit being adjacent to the first portion of the air cell unit in the second direction; and a second pump in a case, the second pump being configured to supply and exhaust air to and from the plurality of the air cells, the case of the second pump being adjacent to the second portion of the air cell unit in the second direction, wherein the first portion is between the first side edge unit and the second side edge unit in the second direction, the second portion is between the case of the first pump and the case of the second pump in the second direction, and the second side edge unit is adjacent in the first direction to the case of the second pump.

4. The air mattress according to claim 2, wherein the second side edge unit includes a plurality of second side edge elements, and an angle between at least two of the plurality of the second side edge elements is changeable.

5. The air mattress according to claim 1, wherein the first side edge unit includes a plurality of first side edge elements, and an angle between at least two of the plurality of the first side edge elements is changeable.

6. The air mattress according to claim 1, further comprising:

a tube that connects at least a part of the plurality of air cells to the first pump, wherein at least a part of the tube passes through an inside of the first side edge unit.

7. The air mattress according to claim 1, further comprising:

a tube that connects at least a part of the plurality of air cells to the first pump, wherein the first side edge unit includes a concave part, and at least a part of the tube is in the concave part.

8. A motorized bed with moveable sections, the motorized bed comprising:

an air mattress according to claim 1, wherein the air mattress is disposed on a knee section and a leg section of the motorized bed.

9. The motorized bed according to claim 8, wherein an angle between the first side edge unit and the case of the first pump is changeable by relative movements of the knee section and the leg section.

10. The motorized bed according to claim 9, wherein a first direction end of the case of the first pump is at a position of a joint between the knee section and the leg section.

11. The air mattress according to claim 1, wherein a first direction end of the case of the first pump is at a position of a joint between the first and second portions of the air cell unit.

12. The air mattress according to claim 1, wherein a thickness of the case of the first pump in a third direction intersecting the first and second directions is substantially the same as a thickness of the first side edge unit in the third direction.

13. The air mattress according to claim 1, wherein upper surfaces of the case of the first pump and the first side edge unit are substantially coplanar with one another.

14. The air mattress according to claim 1, wherein a length of the air cell unit along the first direction is substantially equal to the sum of a length of the case of the first pump along the first direction and a length of the first side edge unit along the first direction.

15. The air mattress according to claim 14, wherein the length of the case of the first pump along the first direction is less than the length of the first side edge unit along the first direction.

16. The air mattress according to claim 3, wherein a length of the case of the first pump along the first direction is the same as a length of the case of the second pump along the first direction, and a length of the first side edge unit along the first direction is the same as a length of the case of the second side edge unit along the first direction.

* * * * *